US007494325B2

(12) United States Patent
Gustafson et al.

(10) Patent No.: US 7,494,325 B2
(45) Date of Patent: Feb. 24, 2009

(54) FAN BLADE WITH RIDGES

(75) Inventors: Thomas J. Gustafson, Piqua, OH (US); Zvirimumwoyo P. Chinoda, Strongsville, OH (US); Kurt A. Hilgefort, Minster, OH (US); Terrence J. Meyer, Covington, OH (US); Carl L. Reck, Covington, OH (US)

(73) Assignee: Hartzell Fan, Inc., Piqua, OH (US)

( * ) Notice: Subject to any disclaimer, the term of this patent is extended or adjusted under 35 U.S.C. 154(b) by 269 days.

(21) Appl. No.: 11/131,522

(22) Filed: May 18, 2005

(65) Prior Publication Data

US 2006/0263223 A1 Nov. 23, 2006

(51) Int. Cl.
*F04D 29/68* (2006.01)

(52) U.S. Cl. ..... 416/236 R; 415/914

(58) Field of Classification Search ..... 416/236 R; 244/130; 415/914

See application file for complete search history.

(56) References Cited

U.S. PATENT DOCUMENTS

| | | | | |
|---|---|---|---|---|
| 1,034,204 | A | 7/1912 | Cobb | |
| 1,725,482 | A | 8/1929 | Schertz | |
| 1,870,216 | A | 8/1932 | Baldwin | |
| 1,943,934 | A * | 1/1934 | Telfer | 416/236 R |
| 2,110,621 | A | 3/1938 | Cohen | |
| D110,876 | S | 8/1938 | Preston | |
| 2,238,749 | A | 4/1941 | Peltier | |
| D127,167 | S | 5/1941 | Bahr | |
| 2,251,887 | A | 8/1941 | Larsh | |
| 2,265,788 | A | 12/1941 | Wolf, Sr. et al. | |
| D131,271 | S | 2/1942 | Collura | |
| 2,385,070 | A | 9/1945 | Gant | |
| 2,959,377 | A * | 11/1960 | Kaplan | 244/198 |
| 3,290,004 | A * | 12/1966 | Ishibashi | 415/119 |
| 3,304,056 | A * | 2/1967 | Sohma | 415/169.4 |
| 3,552,102 | A | 1/1971 | Araki | |
| 3,588,005 | A | 6/1971 | Rethorst | |
| 3,676,985 | A | 7/1972 | Foreman et al. | |
| 3,776,363 | A | 12/1973 | Kuethe | |
| 4,089,618 | A | 5/1978 | Patel | |
| 4,173,458 | A | 11/1979 | Stiles | |
| 4,292,055 | A | 9/1981 | De Castella et al. | |
| 4,706,910 | A | 11/1987 | Walsh et al. | |
| 4,753,573 | A | 6/1988 | McKnight | |
| 4,757,587 | A | 7/1988 | Choi | |
| 4,830,315 | A | 5/1989 | Presz, Jr. et al. | |

(Continued)

OTHER PUBLICATIONS

White, "Other Methods of Drag Reduction," Fluid Mechanics, 5th Ed., Chapter 7, p. 490 (2003).

(Continued)

*Primary Examiner*—Richard Edgar
(74) *Attorney, Agent, or Firm*—Thompson Hine LLP

(57) ABSTRACT

A blade including a body having a leading edge, a trailing edge, a surface point of maximum camber, and a low pressure surface extending between the leading edge and the trailing edge. The body further includes a high pressure surface extending between the leading edge and the trailing edge on an opposite side of the body relative to the low pressure surface. The low pressure surface includes a leading edge surface extending from the leading edge to the surface point of maximum camber. The blade further includes at least two ridges located on the leading edge surface, each ridge extending generally parallel to the leading edge.

35 Claims, 7 Drawing Sheets

U.S. PATENT DOCUMENTS

| | | | | |
|---|---|---|---|---|
| 4,840,650 | A | 6/1989 | Matherne | |
| 4,869,644 | A * | 9/1989 | Takigawa | 415/119 |
| 4,913,381 | A | 4/1990 | Mabey | |
| 5,052,889 | A | 10/1991 | Abdel-Messeh | |
| 5,058,703 | A | 10/1991 | Ealba et al. | |
| 5,133,519 | A * | 7/1992 | Falco | 244/200 |
| 5,169,290 | A | 12/1992 | Chou | |
| 5,370,721 | A | 12/1994 | Carnahan | |
| 5,395,071 | A | 3/1995 | Felix | |
| 5,505,409 | A * | 4/1996 | Wells et al. | 244/130 |
| 5,540,406 | A | 7/1996 | Occhipinti | |
| 5,562,420 | A | 10/1996 | Tangler et al. | |
| 5,766,315 | A | 6/1998 | Moredock | |
| 5,795,131 | A | 8/1998 | Crowhurst et al. | |
| 5,802,947 | A | 9/1998 | Ward, Jr. et al. | |
| 5,863,182 | A | 1/1999 | Hill et al. | |
| 5,873,761 | A | 2/1999 | Johnson | |
| 5,967,754 | A | 10/1999 | Chou | |
| 6,022,192 | A | 2/2000 | DeLaHoz et al. | |
| 6,474,942 | B2 * | 11/2002 | Markytan | 415/169.2 |
| 6,872,048 | B2 * | 3/2005 | Uselton et al. | 415/119 |
| 2003/0098144 | A1 | 5/2003 | Uselton et al. | |
| 2005/0147496 | A1 | 7/2005 | Uselton et al. | |

OTHER PUBLICATIONS

Aviation Week & Space Technology article, p. 90 (Jun. 1, 1987).

"Scout Designed for Transport Work From Short, Unimproved Airfields," Aviation Week & Technology, p. 56 (Apr. 20, 1987).

"Aerograms, Gary Wheeler Spins Air Into More Lift," Aero, p. 3 (Mar. 1987).

"Low-Profile Vortex Generators Provide Aerodynamic Improvements Through Boundary Layer Control," Aviation Week & Space Technology, p. 36 (Nov. 24, 1986).

Streeter, et al., "Viscous Effects: Fluid Resistance," Fundamentals of Fluid Mechanics, 7th Ed., pp. 220-221 (1979).

"Thin Film Micro-Vortex Generators," Vortex Products, (date unknown) Applicants admit the status of this publication as prior art for the limited purpose of examination of this application, but otherwise reserve the right to challenge the status of this publication as prior art.

* cited by examiner

| Blade Type | Blade Pitch | No. of Blades | Fan RPM | Static Pressure | Static Efficiency | Flowrate CFM | Fan Sound Power Corrected per AMCA 300-96 Lwo @ Octave Band Center Frequency | | | | | | | |
|---|---|---|---|---|---|---|---|---|---|---|---|---|---|---|
| | | | | | | | 63 | 125 | 250 | 500 | 1000 | 2000 | 4000 | 8000 |
| | | | | | | | | | | | | | | |
| No Ridges | 24 | 4 | 1174 | 0 | 0 | 22212 | 99.1 | 96.9 | 90.8 | 90.1 | 88 | 84.6 | 82.8 | 76.7 |
| Tape Ridges | 24 | 4 | 1173 | 0 | 0 | 21967 | 96.5 | 96.1 | 90 | 89.3 | 87.2 | 84.3 | 81.9 | 75.9 |
| Cast Ridges | 25 | 4 | 1174 | 0 | 0 | 21400 | 95.7 | 93.4 | 88.7 | 89.8 | 87.5 | 82.1 | 80.9 | 76.1 |
| | | | | | | | | | | | | | | |
| No Ridges | 24 | 4 | 1171 | 0.25 | 24 | 20263 | 97.9 | 95.2 | 87.7 | 90 | 87.5 | 84.1 | 82.9 | 76.4 |
| Tape Ridges | 24 | 4 | 1171 | 0.25 | 24 | 19937 | 93.4 | 92.8 | 86.7 | 88.6 | 86.7 | 83.4 | 82 | 76.1 |
| Cast Ridges | 25 | 4 | 1171 | 0.25 | 24 | 19200 | 96.7 | 90.9 | 89.1 | 89.1 | 86.9 | 81.8 | 81.8 | 77.8 |
| | | | | | | | | | | | | | | |
| No Ridges | 24 | 4 | 1168 | 0.5 | 37 | 17869 | 98.3 | 91.1 | 88.8 | 88.9 | 87.4 | 85.1 | 84.4 | 77.5 |
| Tape Ridges | 24 | 4 | 1168 | 0.5 | 39 | 17822 | 94.7 | 88.5 | 87.6 | 87.8 | 86.6 | 84.2 | 83.6 | 77.6 |
| Cast Ridges | 25 | 4 | 1168 | 0.5 | 40 | 17390 | 97.1 | 93.3 | 92.6 | 91.7 | 89.5 | 84.1 | 83.4 | 78.9 |
| | | | | | | | | | | | | | | |
| No Ridges | 24 | 4 | 1169 | 0.75 | 47 | 14523 | 97.1 | 99.6 | 98.5 | 97.4 | 94.2 | 89.5 | 86.7 | 78.4 |
| Tape Ridges | 24 | 4 | 1170 | 0.75 | 47 | 14270 | 95.3 | 98.9 | 97.2 | 95.9 | 92.9 | 88.5 | 86 | 78 |
| Cast Ridges | 25 | 4 | 1169 | 0.75 | 47 | 13400 | 96.6 | 98.4 | 97.5 | 95.8 | 93.3 | 87.7 | 85.3 | 79.7 |
| | | | | | | | | | | | | | | |
| No Ridges | 24 | 4 | 1169 | 1 | 44 | 9994 | 95.7 | 96.8 | 91.9 | 90.6 | 87.8 | 84.6 | 83.8 | 77.1 |
| Tape Ridges | 24 | 4 | 1169 | 1 | 40 | 9077 | 94.4 | 95.9 | 90.7 | 89.9 | 87 | 83.9 | 83.5 | 77.5 |
| Cast Ridges | 25 | 4 | 1169 | 1 | 47 | 9980 | 96.3 | 96.8 | 92.3 | 90.1 | 87.4 | 84.7 | 84.9 | 78.9 |
| | | | | | | | | | | | | | | |
| No Ridges | 21 | 3 | 1183 | 0 | 0 | 19569 | 96.1 | 94.4 | 88.5 | 87.3 | 85.6 | 83.4 | 81.4 | 76.2 |
| Cast Ridges | 21 | 3 | 1185 | 0 | 0 | 18966 | 91.8 | 90.7 | 88.9 | 87.8 | 84.9 | 81.2 | 80.1 | 75 |
| | | | | | | | | | | | | | | |
| No Ridges | 21 | 3 | 1181 | 0.25 | 30 | 17288 | 96.4 | 90.3 | 86.6 | 86 | 84.3 | 82 | 82.3 | 76.2 |
| Cast Ridges | 21 | 3 | 1183 | 0.25 | 31 | 16359 | 92.5 | 88.6 | 89.1 | 87.8 | 84.7 | 80.2 | 80.9 | 76.4 |
| | | | | | | | | | | | | | | |
| No Ridges | 21 | 3 | 1179 | 0.5 | 47 | 14792 | 98.5 | 93.7 | 85.2 | 87.9 | 85.6 | 83.7 | 85 | 77.7 |
| Cast Ridges | 21 | 3 | 1182 | 0.5 | 48 | 13822 | 93.8 | 94.9 | 91 | 92.4 | 90 | 84.4 | 82.8 | 77.9 |
| | | | | | | | | | | | | | | |
| No Ridges | 21 | 3 | 1179 | 0.75 | 51 | 10638 | 98.3 | 99 | 94.4 | 92 | 88.6 | 85.5 | 84.9 | 76.7 |
| Cast Ridges | 21 | 3 | 1182 | 0.75 | 50 | 9365 | 95.4 | 95.6 | 91.6 | 89.4 | 86.5 | 83.2 | 82.5 | 75.8 |
| | | | | | | | | | | | | | | |
| No Ridges | 21 | 3 | 1180 | 1 | 37 | 5994 | 100.5 | 95.5 | 89.9 | 88.8 | 85.7 | 83.3 | 84.2 | 77.6 |
| Cast Ridges | 21 | 3 | 1182 | 1 | 30 | 4219 | 98.8 | 96.8 | 92.2 | 89.8 | 86.4 | 84.5 | 85.2 | 80.1 |

FIG. 6

FAN BLADE WITH RIDGES

The present invention is directed to a fan blade, and more particularly, to a fan blade which can reduce the noise output of a fan on which the fan blade is utilized.

BACKGROUND

Blades are used in a wide variety of fluid-accelerating and fluid-moving equipment, such as ventilation systems, blast fans, cooling fans, centrifugal blowers, impellers, propellers and the like. The fluid-accelerating and fluid-moving equipment typically includes a central rotatable hub and a plurality of radially-extending blades mounted onto the hub. Each blade may include a generally airfoil-shaped body having a low pressure surface and a high pressure surface located opposite the low pressure surface.

Due to the pressure forces, the fluid that flows over the high pressure surface of the blade typically remains attached to the blade. However, fluid that flows over the low pressure surface of the blade tends to separate from the blade, which creates a wake in the flow, primarily at the rear edge of the blade. The wake is a regime of chaotic air particles which can cause increased noise and a loss of efficiency. Accordingly, there is a need for a blade which has improved attachment of the flow thereto to improve the performance of the blade.

SUMMARY

In one embodiment, the present invention is directed to a fan blade that improves attachment of the flow thereto and therefore improves the performance of the blade, particularly at relative low speed flows. More particularly, in one embodiment the present invention is a blade including a body having a leading edge, a trailing edge, and a low pressure surface extending between the leading edge and the trailing edge. The body further includes a high pressure surface extending between the leading edge and the trailing edge on an opposite side of the body relative to the low pressure surface. The low pressure surface includes a leading edge surface extending from the leading edge to a surface point of maximum camber. The blade further includes at least two ridges located on the leading edge surface, each ridge extending generally parallel to the leading edge.

BRIEF DESCRIPTION OF THE DRAWINGS

FIG. 4B is a detail view of the area 4B indicated in FIG. 4A;

FIG. 6 is a table illustrating the performance of several embodiments of the fan blade of the present invention under varying test conditions.

DETAILED DESCRIPTION

In one embodiment the invention is a fan blade that reduces noise output, as well as a fan that utilizes the fan blade. However, it should be appreciated that it is within the scope of the invention to utilize the invention described and claimed herein in nearly any type of fluid-accelerating and/or fluid-moving equipment that utilizes blades. Such fluid-accelerating and fluid-moving equipment may include, for example, ventilation systems, blast fans, cooling fans, centrifugal blowers, impellers, propellers and the like.

Figure 1:
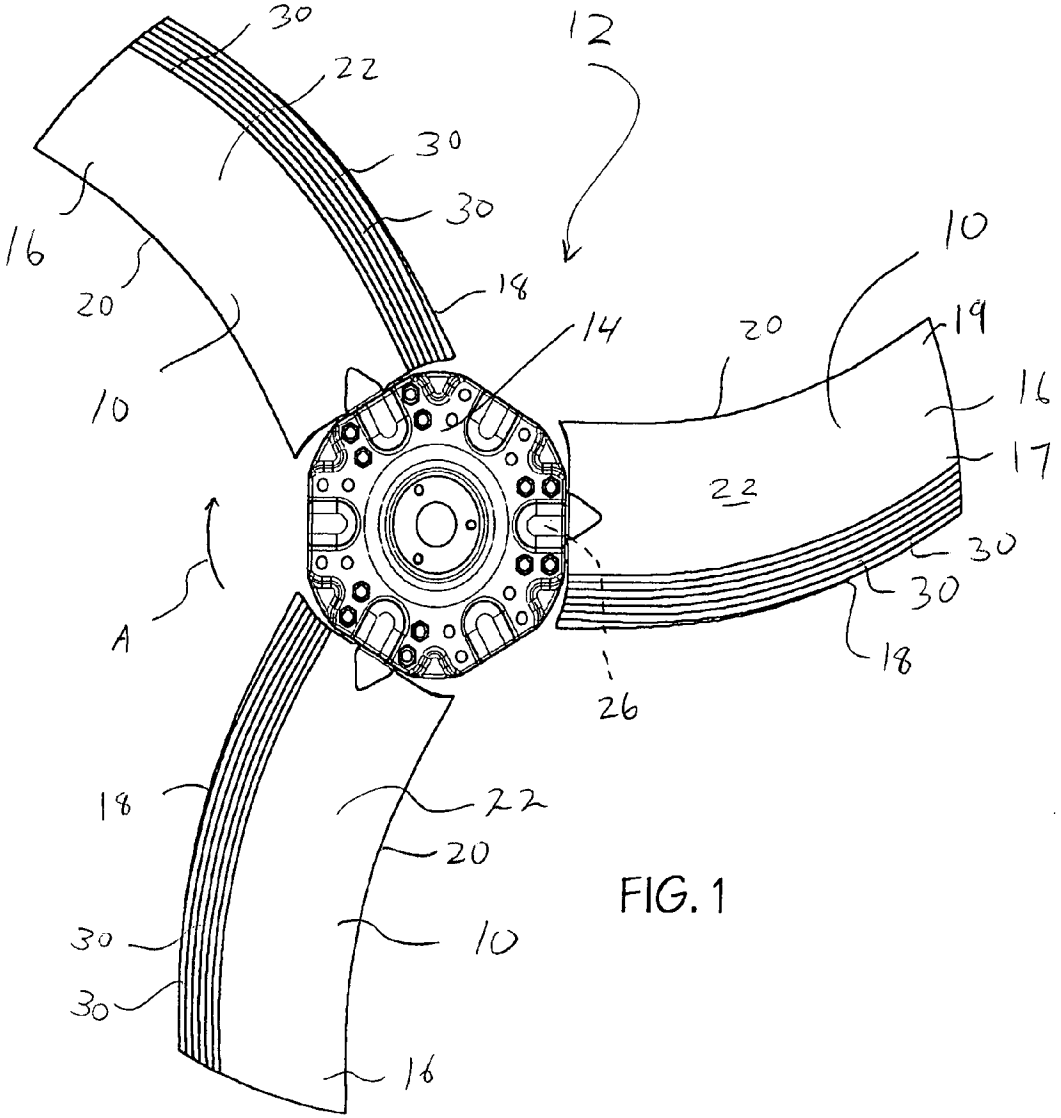
FIG. 1 is a top plan view of fan blade assembly incorporating a number of fan blades of one embodiment of the present invention.

As shown in FIG. 1, in one embodiment the blades of the present invention, each generally designated 10, can be used as part of a fan 12 having a central, rotatably driven hub 14. A plurality of blades 10 (three in the illustrated embodiment) are attached to the hub 14 and extend generally radially outwardly therefrom. Each blade 10 includes a mounting stub 26 (FIG. 2) on its radially inner end that is attachable to the hub 14 to couple each blade 10 to the hub 14. The hub 14 and blades 10 can be rotatably driven by a motor (not shown) in the direction indicated by arrow A, and arrow B represents the free stream velocity of fluid as experienced by the blades 10 during rotation. In this case the fan 12 accelerates the surrounding fluid in a direction perpendicular to the page of FIG. 1.

Figure 2:
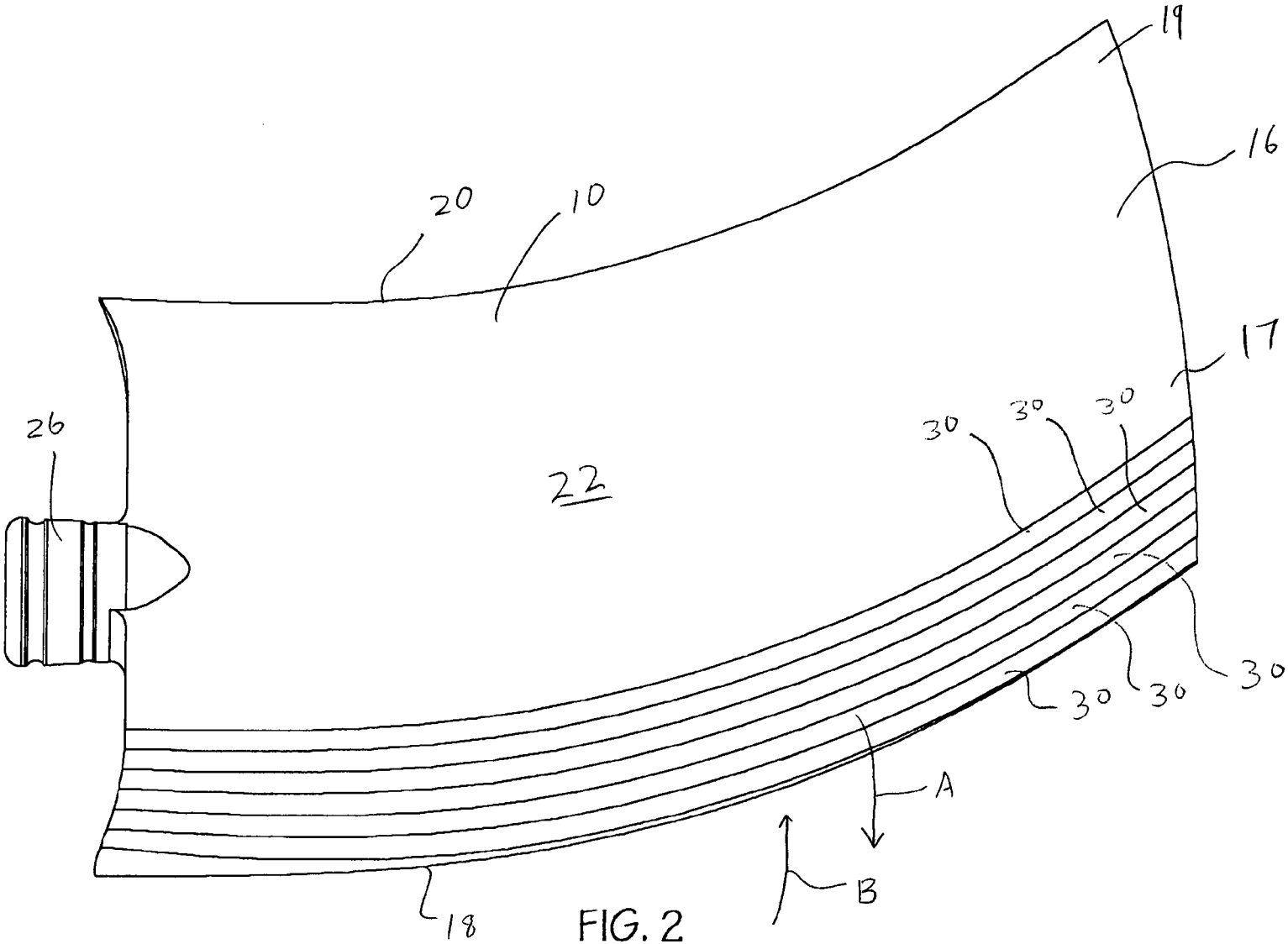
FIG. 2 is a top view of a blade of the fan of FIG. 1.
Figure 3:
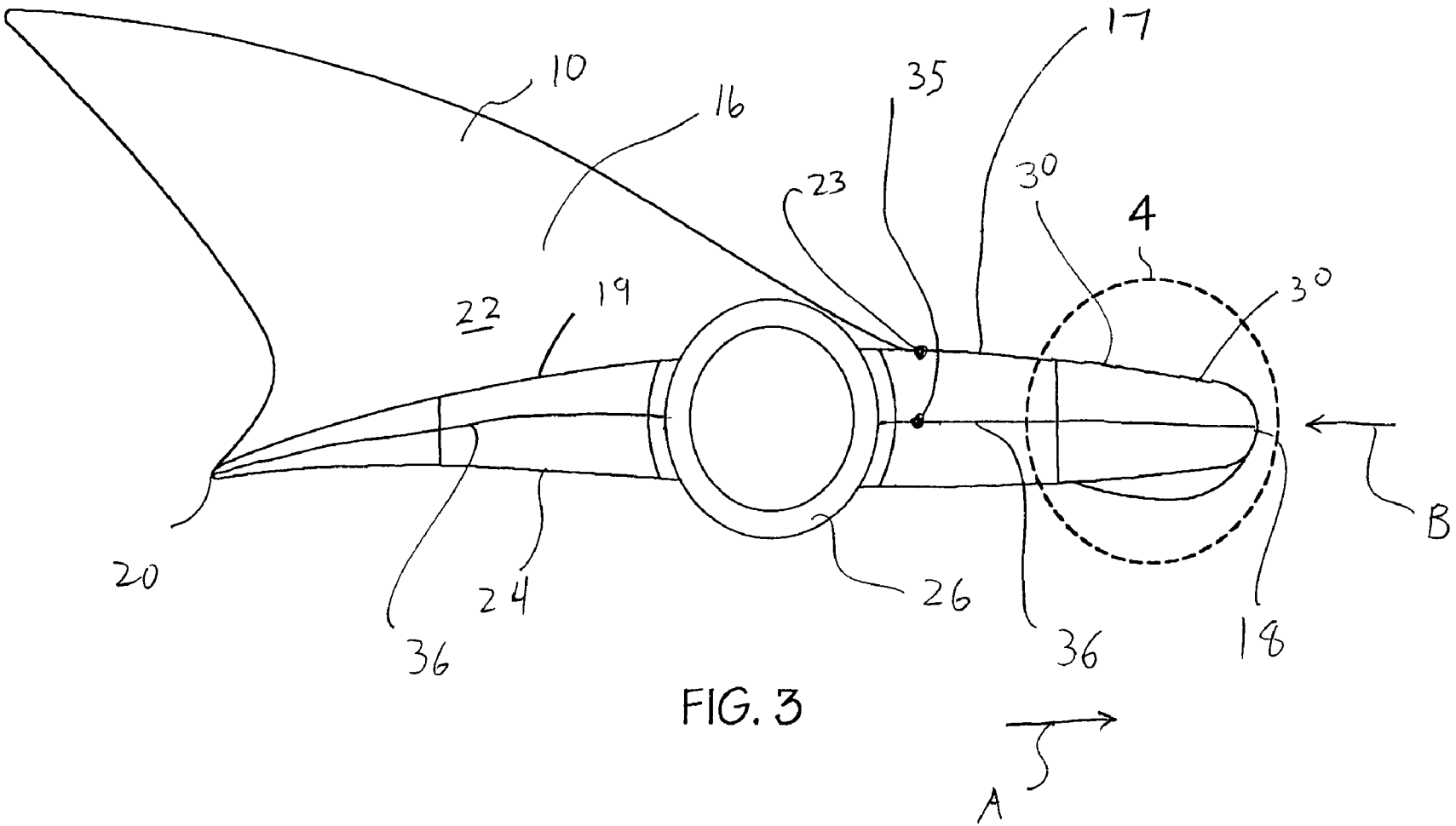
FIG. 3 is an end view of the blade of FIG. 2.
Figure 4:
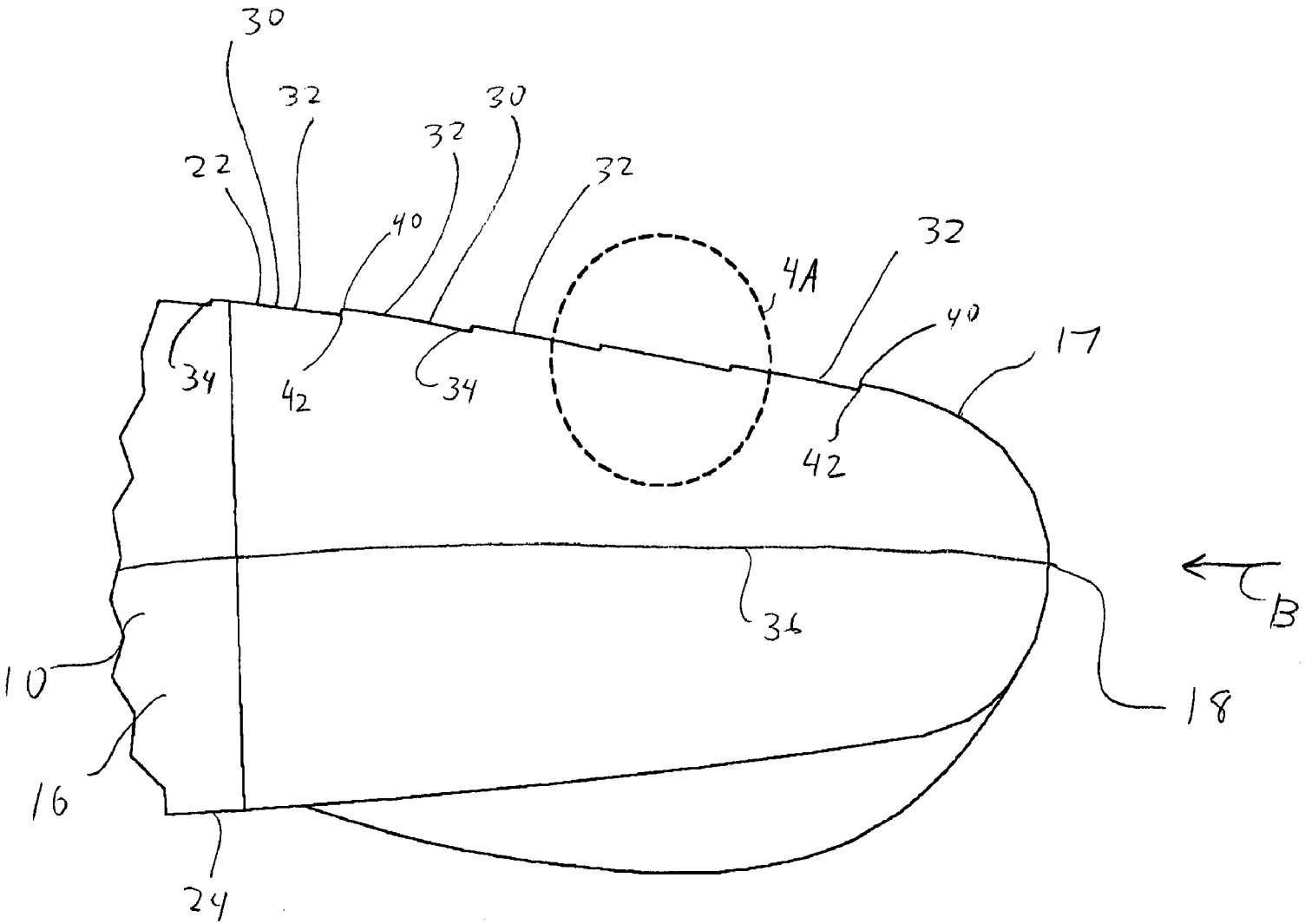
FIG. 4 is a detail view of the leading edge of the blade of FIG. 3, indicated in FIG. 3.

As best shown in FIGS. 2-4, each blade 10 may include a body 16 that is generally airfoil shaped in end view or in cross section. The body 16 may have a leading edge 18, a trailing edge 20, a low pressure surface 22 extending from the leading edge 18 to the trailing edge 20 and a high pressure surface 24 extending from the leading edge 18 to the trailing edge 20 on an opposite side of the body 16 relative to the low pressure surface 22. When the fan 12 is operated, the low pressure surface 22 has a relatively higher-velocity, lower-pressure airflow flowing over it as compared to the high pressure surface 24.

Each blade 10 includes a mean camber line 36 (FIG. 3) and a camber line maximum thickness point 35 located on the mean camber line 36 at the largest thickness or camber of the blade 10. Each blade 10 includes a surface point of maximum camber 23 which is a point located on the low pressure surface 22 directly vertically above the camber line maximum thickness point 35. The low pressure surface 22 is defined by a leading edge curve or surface 17 extending from the leading edge 18 to the surface point of maximum camber 23, and a trailing edge curve or surface 19 extending from the surface point of maximum camber 23 to the trailing edge 20. Each blade 10 may also be considered to have a leading edge portion 17 that is located on the front or leading half of the blade, and a trailing edge portion 19 that is located on the rear or trailing half of the blade 10.

Referring primarily to FIGS. 2, 3, 4 and 4A, each blade 10 may include a plurality of ridges 30 located on the leading edge surface 17. Each ridge 30 may be located generally adjacent to the associated leading edge 18 and extend generally parallel to the associated leading edge 18 (i.e. extending generally span-wise or along the span of the blade 10). While two or more of the ridges 30 may be used, and in particular six ridges may provide good performance, it is within the scope of the invention to utilize nearly any number of ridges.

Figure 4A:
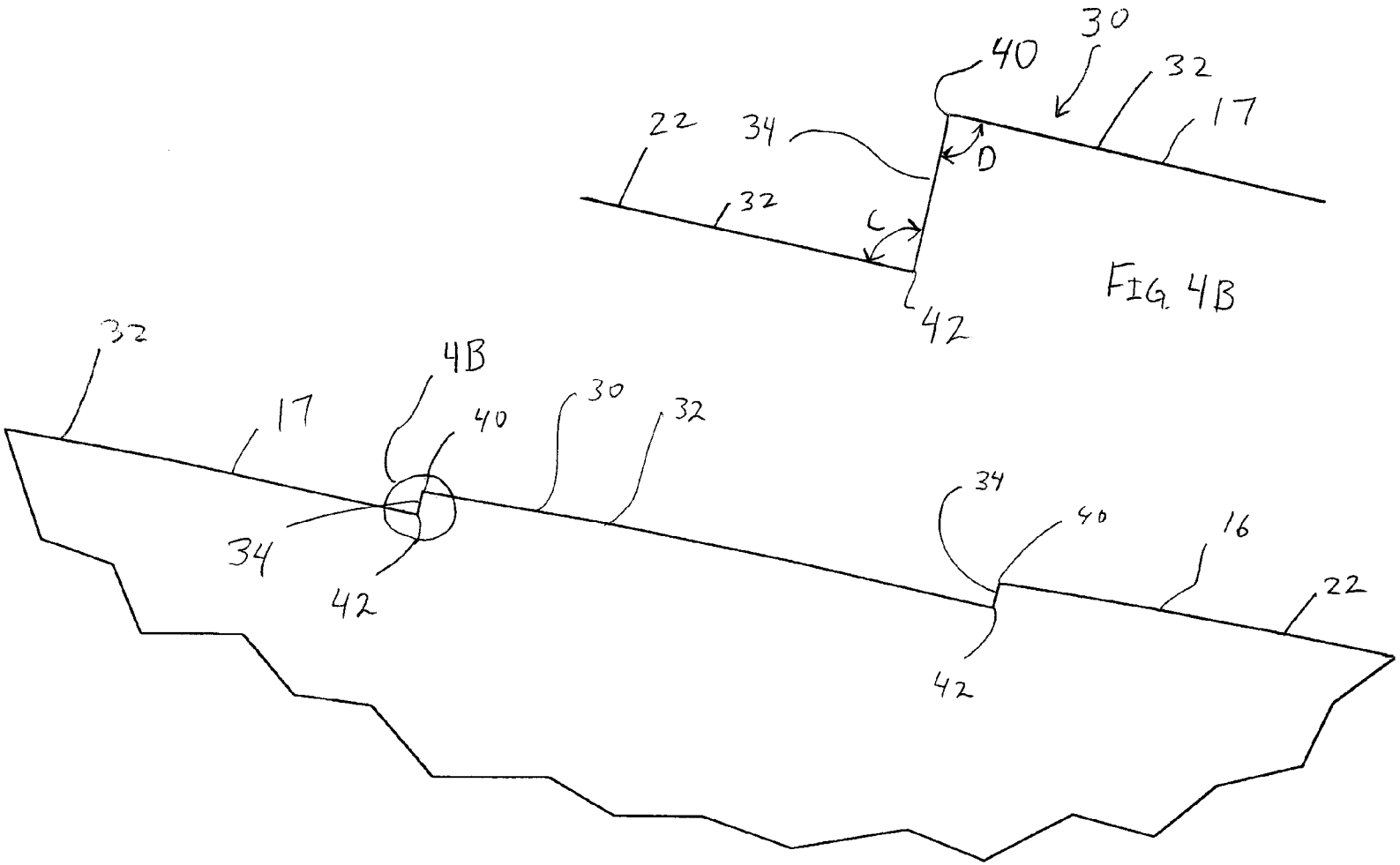
FIG. 4A is a detail view of the area 4A indicated in FIG. 4.

The ridges 30 may be located upstream of the point of maximum camber 23 of the blade 10 such that the ridges 30 are located on the leading edge surface 17. As best shown in FIGS. 4A and 4B, each ridge 30 may include and/or be defined by a generally horizontally oriented surface or slightly upward sloping surface 32, and by a generally vertically oriented or downward sloping surface 34. Each upward sloping surface 32 may be located on a leading edge side of the associated ridge 30 and the associated downward sloping surface 34 may be located on the trailing edge side of the ridge 30. If desired, the bottom surface or high pressure surface 24 of each blade 10 can be relatively smooth and lack any ridges located thereon.

Each upward sloping surface 32 may be slightly curved to generally match the natural shape or curve of the leading surface curve 17 or to generally match the curve of the mean camber line 36. Alternately, each upward sloping surface 32 may be generally parallel to the flow of fluid over the body 16. Further alternately, each upward sloping surface 32 may be a generally planar, flat surface.

Each downward sloping surface 34 may be a generally planar surface that is generally perpendicular to the leading edge surface 17, or to the mean chamber line 36, or to the flow of fluid over the body 16, or to the upward sloping surface 32. However, the downward sloping surfaces 34 need not be perfectly perpendicular to the leading edge surface 17, mean chamber line 36, the flow of fluid, or to the upward sloping surface 32. In fact, due to manufacturing tolerances, it may be difficult to provide downward sloping surfaces 34 that are perfectly perpendicular to the component or line of interest.

Each downward sloping surface 34 includes a lower edge 42 and an upper edge 40. Each upward sloping surface 32 extends away (in a downstream direction) from the lower edge 42 of a downward sloping surface 34 to the upper edge 40 of an adjacent downstream downward sloping surface 34. In this manner, as shown in FIG. 4A, the ridges 30 may be generally triangular in cross section and arranged in a stepwise manner along the leading edge curve 17 of the low pressure side 22. However, the ridges 30 may be a variety of shapes in side view, including rectangular, trapezoidal, and other shapes. Regardless of the shape of the ridges 30, each ridge 30 may provide a point or points of sharp transition (i.e., at points 40 and/or 42).

In one embodiment, as shown in FIG. 4B, each upward sloping surface 32 forms an angle C with an upstream, adjacent downward sloping surface 34. The angle C may range between about 30 degrees and about 150 degrees, or more particularly between about 70 degrees and about 110 degrees, and even more particularly may be about 90 degrees. Each downward sloping surface 34 may form an angle D with an adjacent upstream upward sloping surface 32. The angle D may range between about 30 degrees and about 110 degrees, or more particularly between about 70 degrees and about 110 degrees, and even more particularly may be about 90 degrees. The angle D may be about the same angle as angle C to ensure the upward sloping surfaces 32 are parallel with each other.

Thus, the ridges 30 may be formed by the junction of any two surfaces or planes, wherein the junction runs generally parallel to the leading edge 18. The junction may be a relatively sharp or obtuse junction of two surfaces or planes to form a well-defined ridge 30. The surfaces or planes may be relatively flat, for example, in one case having a radius of curvature of greater than about 12 inches.

Each upward sloping surface 32 may have a length greater than the height of its associated downward sloping surface 34. For example, each upwardly sloping surface 32 may be at least about 5 times longer, or at least about 15 times longer, or between about 15 and about 30 times longer than the height of an associated downward sloping surface 34. Each upward sloping surface 32 may have a length that is less than about 5% of the chord length of the blade 10. Alternately, each generally upward sloping surface 32 may have a length that is between about 30 and about 40 times shorter than the chord length of the blade 10.

Each downward sloping surface 34 may have a length of less than about 0.1 inch, or between about 0.005 inches and about 0.05 inches. Each upward sloping surface 32 may have a length of less than about 1 inch, or between about 0.2 inches and about 1 inch. Thus each ridge 30 may protrude upwardly from the body by less than about 0.1 inch, or less than about 0.05 inches, or less than about 0.005 inches.

Each ridge 30 should protrude upwardly by a sufficient distance to cause the desired turbulence/vortex in the airflow to improve attachment of the airflow to the blade 10. It should be understood, however, that it is within the scope of the invention to vary the size, shape, dimension and relative sizes of the upward sloping surfaces 32 and downward sloping surfaces 34 to accommodate varying conditions such as temperature, velocity and viscosity of the flow, differing blade shapes and sizes, and the like.

As shown in FIG. 2, in one embodiment each ridge 30 extends substantially the entire length (i.e., span-wise) of the associated blade 10 and extends generally parallel to the leading edge 18. However, each ridge 30 need not extend the entire length of each blade 10, and one or more of the ridges 30 may include one or more discontinuities formed therein. If a ridge 30 includes a discontinuity or discontinuities, the discontinuities may be relatively small relative to the length of the ridge 30 such that the ridges 30 may extend substantially the entire length (i.e., at least about 95%) of each blade 10, or at least the majority of the length of the blade 10.

In one embodiment, the blade 10 has a curved rearward sweep as shown in FIG. 2 and a twist or variable pitch (with pitch angles extending from 10 to 40 degrees) as shown in FIG. 3. However, the ridges 30 of the present invention may be used with nearly any type of blade 10, regardless of whether the blade 10 has a sweep and/or a variable pitch.

Each ridge 30 may be of a sufficient size to act as a vortex generator when fluid of sufficient velocity flows over the body 16 to thereby introduce turbulence into the fluid flow. The introduced turbulence causes the fluid to remain attached to the low pressure surface 22 of the body 16 for a longer distance than it would without the ridges 30. By increasing the attachment of the flow to the low pressure surface 22, the size of the wake, and correspondingly, the noise generated by fluid flowing over the body 16, is reduced. The increased attachment of the flow may also reduce pressure drag and may increase the efficiency of the fan.

The ridges 30 may also be staggered in length. For example, in one embodiment the leading strip ridge 30 extends the entire radial length of the blade 10, the next ridge 30 is shorter by about 1", the next downstream ridge 30 is shorter than the ridge 30 by about 2", etc. Further alternately, the ridges 30 may also be located only on one radial segment of the blade 10, such as an outer radial segment (i.e. the outer half) of the blade 10, or on an inner radial segment (i.e. an inner half) of the blade 10.

The fan 12 may include a mounting frame (not shown) and other hardware upon which the motor, hub 14 and blades 10 are mounted. Each blade 10 may have a length of between about 5" and about 50". The fan 12 may be configured to rotate between about 600 to 3600 rpm and at a velocity of between about 3,000 ft/min and about 18,000 ft/min, or less than about 10,000 ft/min. The blades 10 may be moved such that they have a tip velocity of less than about 16,000 ft/min. The fan 10 may operate at a static pressure of between about 0 and about 2 inches of water, wherein the static pressure represents the back pressure in the system (i.e., in ductwork or the like) against which the fan must work. The fan 10 may include 2, 3, 4, 6 or more blades, and each blade 10 may be oriented at a blade pitch of about 13 to about 40 degrees.

In one embodiment, the fan 12 is a 36" diameter fan having a blade length of about 13.5" and a blade volume of about 42.8 cu. in. The length of the upward sloping surface 32 of each ridge 30 (i.e. the distance between the upper 40 and lower 42 edges) is about 0.25" and the length of the downward sloping surface 34 of each ridge 30 is about 0.012". In another embodiment, the fan 12 is a 48" diameter fan having a blade length of about 18" and a blade volume of about 90.4 cu. in. In this case, the length of the upward sloping surface 32 of each ridge 30 is about 0.334" and the length of the downward sloping surface 34 of each ridge 30 is about 0.014".

The blades 10 may be made of metal, such as cast aluminum, and the ridges 30 can be unitary with the body 16 such that the body 16 and ridges 30 are formed of a single piece of material. For example, the ridges 30 may be cast or molded as part of the body 16. However, the ridges 30 may be integral with and/or coupled to the body 16. In addition, an existing blade can be retrofit to include the ridges of the present invention.

Figure 5:
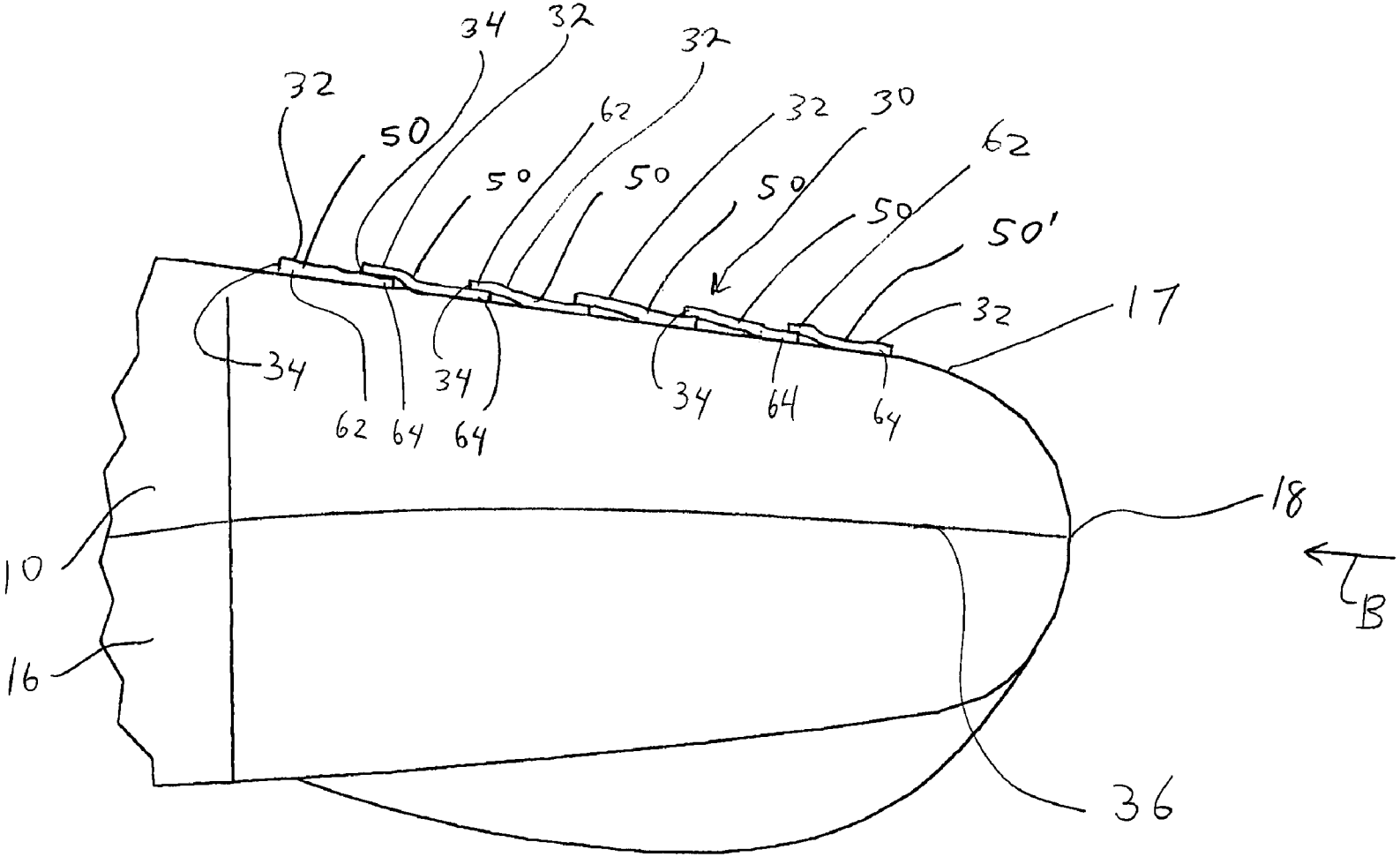
FIG. 5 is a detail end view of the leading edge of an alternate embodiment of the blade of the present invention.

For example, as shown in FIG. 5, strips 50 of relatively thin material can be layered onto the leading edge surface 17 of the blade 10 to create the ridges 30 having an upward sloping portion 32 and a downward sloping portion 34 (the thickness of the strips 50 has been exaggerated in FIG. 5 for ease of illustration). For example, an adhesive strip of material, such as duct tape or other adhesive tape, can be layered on a blade 10 such that the downstream edge 62 of one strip of tape 50 overlaps onto the leading edge 64 of an adjacent, downstream strip of tape. It has been found that this retrofitting method produces an immediate and noticeable reduction in noise generated by a blade at sufficient velocities, and is also believed to increase efficiency.

The strips 50 may have a variety of thicknesses, such as between about 5 and about 80 mils. If desired, one strip 50 may comprise or be made of a number of thinner strips layers stacked on top of each other. The width of each strip 50 (i.e. the left-to-right dimension of the strips 50 in FIG. 5) can vary, but may be about 0.75 inches or less. While it has been found that six strips 50 provide good results in certain applications, it is within the scope of the invention to utilize any number of strips 50, such as between 3 and 9 strips or various other numbers.

The leading strip 50' or ridge 30 may be located from about ⅛" to about ½" away from the leading edge 18 of the blade 10. The strips 50 may overlap each other for a variety of distances, such as between about ⅛" and about ½". In one particular embodiment the strips 50 overlap each other by about ¼", and the leading strip 50' is located about ¼" from the leading edge 18 of the blade. Each strip 50 may be about 12 mils thick and about ¾" wide and may extend substantially the entire spanwise length of the blade 10.

In addition, if desired, a blade having ridges 30 formed by such strips, adhesive tape or the like can be used to form a mold. That mold may then be used to create a cast blade having integral ridges that are of substantially the same shape and dimension as the blades having ridges 30 formed by the strips 50.

It should be appreciated that the ridges 30 may be formed by a variety of alternative methods and means in addition to those described herein. For example, a leading edge airfoil section may be formed by adding a relatively thick portion of tape (i.e. 72 mils thick) on the leading edge surface 17 of the blade 10, and the ridges can be formed by cutting longitudinal "V" shaped notches in the tape to define the ridges. In one case, two V-shaped notches may be cut and extend the length of the blade 10 and be spaced apart by about 1½". "V"-shape or other shape notches can also be cut into the body 16 of the blade 10.

FIG. 6 is a table illustrating the performance of fans incorporating various embodiments of the fan blades 10. The table illustrates performance results for varying blade pitches, blade numbers, RPMs, and static pressure. And for each of these tested arrangements, the table provides the static efficiency, flow rate (in cubic feet per minute) and the sound power produced fans having three types of blades: (1) blades with no ridges; (2) blades with ridges 30 formed by the strips 50; and (3) blades with unitary or cast ridges.

As can be seen from the table of FIG. 6, the presence of the ridges 30, in either their cast or taped form, improves the sound performance of the of the fan, especially with the low pressure applications. For example, a four-blade fan with cast ridges running at 1174 RPM and at a static pressure of zero has a relative sound reduction (as compared to the non-ridged fan) of about 3.4 decibels at an octave band center frequency of 63 Hz, 3.5 decibels at an octave band center frequency of 125 Hz, 2.1 decibels at an octave band center frequency of 250 Hz, 0.3 decibels at an octave band center frequency of 500 Hz, 0.5 decibels at an octave band center frequency of 1000 Hz, 2.5 decibels at an octave band center frequency of 2000 Hz, 1.9 decibels at an octave band center frequency of 4000 Hz, and 0.6 decibels at an octave band center frequency of 8000 Hz.

While the apparatuses and processes herein described in the above description and summaries constitute various embodiments of the present invention, it is to be understood that the invention is not limited to these precise apparatuses and processes, and that changes may be made therein without departing from the scope of the invention as defined by the claims. Additionally, it is to be understood that the invention is defined by the claims and it is not intended that any limitations or elements describing the various embodiments herein are to be incorporated into the meaning of the claims unless such limitations or elements are specifically listed in the claims. As will be apparent to those of ordinary skill, other inherent and/or unforeseen advantages of the present invention may exist even though they may not be explicitly discussed herein.

What is claimed is:

1. A blade comprising:

a body having a leading edge, a trailing edge, a low pressure surface extending between the leading edge and the trailing edge, and a high pressure surface extending between the leading edge and the trailing edge on an opposite side of the body relative to the low pressure surface, the low pressure surface including a leading edge surface extending from the leading edge to a surface point of maximum camber; and at least two ridges located on the leading edge surface, each ridge extending generally parallel to the leading edge, wherein each ridge includes a generally upward sloping surface oriented generally parallel to a mean camber line of the body, and a generally downward sloping surface oriented generally perpendicular to the mean camber line, wherein said low pressure surface is not entirely covered by said ridges, and wherein said ridges are configured to provide noise reduction during use of said blade.

2. The blade of claim 1 wherein each is oriented generally parallel to the leading edge surface and each downward sloping surface is oriented generally perpendicular to the leading edge surface.

3. The blade of claim 1 wherein the generally upward sloping surface of each ridge terminates adjacent to an associated generally downward sloping surface.

4. The blade of claim 1 wherein the generally upward sloping surface of each ridge forms an angle of between about 70 degrees and about 110 degrees with the associated generally downward sloping surface.

5. The blade of claim 1 wherein the upward sloping surface of each ridge is longer than its associated downward sloping surface.

6. The blade of claim 1 wherein the upward sloping surface of each ridge is at least about 5 times longer than its associated downwardly sloping surface.

7. The blade of claim 1 wherein the upward sloping surface of each ridge is generally flat.

8. The blade of claim 1 wherein the body is generally airfoil shaped in cross section, and is generally smooth in areas not covered by said ridges.

9. The blade of claim 8 wherein the body has a chord and the upward sloping surface of each ridge has a length that is less than about 5% of the length of the chord.

10. The blade of claim 1 wherein the at least two ridges extend along a majority of the span of the body.

11. The blade of claim 1 wherein the blade includes at least six ridges having generally the same size and shape.

12. The blade of claim 1 wherein the ridges are unitary with the body.

13. The blade of claim 1 wherein the ridges are adhered to the body.

14. The blade of claim 1 wherein each ridge is formed at the junction of said generally upward sloping surface and said generally downwardly sloping surface.

15. The blade of claim 14 wherein each generally upward sloping and generally down sloping surface is generally flat.

16. The blade of claim 1 wherein the high pressure surface is generally flat and lacks any ridges.

17. The blade of claim 1 wherein each ridge protrudes upwardly from the blade body by a distance of less than about 0.1 inch.

18. The blade of claim 1 wherein the body is configured such that during forward movement of the blade the low pressure surface experiences a lower air pressure thereon as compared to the high pressure surface.

19. The blade of claim 1 wherein each ridge extends substantially the entire distance from a base to a tip of the body.

20. A blade comprising:

a body having a leading edge, a trailing edge, a low pressure surface extending between the leading edge and the trailing edge, and a high pressure surface extending between the leading edge and the trailing edge on an opposite side of the body relative to the low pressure surface, the low pressure surface including a leading edge surface extending from the leading edge to a surface point of maximum camber; and at least two ridges located on the leading edge surface, each ridge extending generally parallel to the leading edge, wherein the ridges are adhered to the body and wherein the ridges are formed by overlapping strips of generally flat adhesive material.

21. A blade comprising:

a blade body having a pair of opposed sides, each side having a leading edge portion and a trailing edge portion; and a plurality of ridges located on the leading edge portion, each ridge being defined by a junction between a generally horizontally oriented surface and a generally vertically oriented surface that is shorter than the associated generally horizontally oriented surface, wherein each ridge extends generally parallel to a leading edge of the blade, wherein said blade body is not entirely covered by said ridges, and wherein said ridges are configured to provide noise reduction during use of said blade.

22. The blade of claim 21 wherein each generally horizontally oriented surface is generally parallel to a mean camber line of the body, and wherein each generally vertically oriented surface is generally perpendicular to the mean camber line.

23. A blade comprising:

a generally airfoil-shaped blade body having a pair of opposed sides, each side having a leading edge portion and a trailing edge portion; and a plurality of ridges located on the leading edge portion of only one of said opposed sides, each ridge extending generally parallel to a leading edge of the blade and being defined by a junction between a pair of generally flat surfaces of unequal length, wherein one of the generally flat surfaces is oriented generally horizontally and the other one of the generally flat surfaces is oriented generally vertically, wherein said side of said blade body having said plurality of ridges is not entirely covered by said ridges, and wherein said ridges are configured to provide noise reduction during use of said blade.

24. The blade of claim 23 wherein one of the flat surfaces is at least 5 times longer than the other generally flat surface.

25. The blade of claim 23 wherein each ridge protrudes upwardly from the blade body by a distance of less than about 0.1 inch.

26. The blade of claim 23 wherein the ridges are unitary with the blade body.

27. The blade of claim 23 wherein each ridge extends substantially the entire distance from a base to a tip of the blade body.

28. A fan comprising:

a motor;

a central hub configured to be rotatably driven by the motor; and a plurality of fan blades coupled to the hub, each fan blade comprising a body having a leading edge, a trailing edge, a low pressure surface extending between the leading edge and the trailing edge, and a high pressure surface extending between the leading edge and the trailing edge on an opposite side of the body relative to the low pressure surface, the low pressure surface including a leading edge surface extending from the leading edge to a surface point of maximum camber, and each fan blade including at least two ridges located on the leading edge surface, each ridge extending generally parallel to the leading edge, wherein each ridge includes a generally upward sloping surface oriented generally parallel to a mean camber line of the body, and a generally downward sloping surface oriented generally perpendicular to the mean camber line, wherein said low pressure surface is not entirely covered by said ridges, and wherein said ridges are configured to provide noise reduction during operation of said fan.

29. The fan of claim 28, wherein the fan includes at least three blades.

30. The fan of claim 28 wherein the ridges of each fan blade are unitary with the associated body.

31. The fan of claim 28 wherein each ridge of each fan blade extends generally radially substantially the entire distance from a base to a tip of associated body.

32. The fan of claim 28 wherein said fan is configured such that when said fan has four blades and is operated in air at about 1174 RPM, at a static pressure of zero, at a static efficiency of zero, at a blade pitch of between about 24 and about 25 degrees, and at a flow rate of about 22212 CFM, said fan has a sound output that is less than the sound output of a fan operated at the same conditions, but without said ridges, by at least about 3.4 decibels at an octave center band frequency of 63 Hz.

33. A fan comprising:

a central hub;

a motor operatively coupled to the central hub to rotatably drive the central hub; and a plurality of blades coupled to the hub and extending radially outwardly therefrom, each blade having a leading surface portion and a trailing surface portion and having at least two generally upwardly protruding ridges located on the leading edge portion, each ridge extending generally parallel to a leading edge of the blade and wherein each ridge protrudes upwardly by a distance of less than about 0.1 inch, wherein said trailing surface portion is not entirely covered by ridges, and wherein said ridges are configured to provide noise reduction during operation of said fan, wherein each ridge is formed at the junction of two generally flat surfaces, wherein one of the flat surfaces is longer than the other generally flat surface.

34. The fan of claim 33 wherein one of the flat surfaces is at least 5 times longer than the other generally flat surface.

35. The fan of claim 33 wherein each blade is generally smooth in areas not covered by said ridges.

* * * * *